United States Patent [19]

Delaney

[11] 4,222,596

[45] Sep. 16, 1980

[54] VENTILATION STOP FOR WINDOWS

[76] Inventor: John H. Delaney, 146-25 20th Rd., Whitestone, N.Y. 11357

[21] Appl. No.: 924,179

[22] Filed: Jul. 13, 1978

Related U.S. Application Data

[63] Continuation-in-part of Ser. No. 765,632, Feb. 4, 1977, Pat. No. 4,103,947.

[51] Int. Cl.[2] ..... E05C 3/04

[52] U.S. Cl. ..... 292/342; 292/DIG. 9

[58] Field of Search ..... 292/DIG. 9, 342, 202, 292/238, DIG. 47, 210

[56] References Cited

U.S. PATENT DOCUMENTS

| | | | |
|---|---|---|---|
| 888,039 | 5/1908 | Rosenberg | 292/DIG. 9 |
| 889,261 | 6/1908 | Prouty | 292/202 |
| 1,559,735 | 11/1925 | Bäuml | 292/DIG. 9 |
| 1,818,043 | 8/1931 | Coady et al. | 292/DIG. 9 |
| 1,950,251 | 3/1934 | Kulefsky | 292/DIG. 9 |
| 1,992,683 | 2/1935 | Webb et al. | 292/DIG. 9 |
| 2,415,166 | 2/1947 | FitzGerald | 292/342 |
| 2,416,127 | 2/1947 | Spivak | 292/342 |
| 2,555,915 | 6/1951 | Christie | 292/342 |
| 2,931,676 | 4/1960 | Wroughton | 292/DIG. 9 |
| 4,103,947 | 8/1978 | Delaney | 292/DIG. 9 |

*Primary Examiner*—Richard E. Moore

[57] ABSTRACT

A ventilation stop mounted on a side rail of the upper sash of a double-hung window, capable of being swung into and out of the path of the upper horizontal rail of the lower sash to permit only limited relative opening movement of the upper and lower sashes.

3 Claims, 11 Drawing Figures

VENTILATION STOP FOR WINDOWS

RELATED APPLICATIONS

This application is a continuation-in-part of application Ser. No. 765,632, filed Feb. 4, 1977, now U.S. Pat. No. 4,103,947.

BACKGROUND OF THE INVENTION

Many prior attempts have been made with limited success to design a convenient, effective and simple stop device which when mounted to one sash of a double-hung window permits limited opening of either or both sashes for ventilation. It is important, of course, for such a device to be mounted so as to be inaccessible to an outsider seeking entry, and in this sense the device serves to lock or prevent opening of the window beyond that permitted by the stop device.

U.S. Pat. Nos. 94,791; 1,047,191; 888,039; 928,339; 2,167,960; and 2,331,676 are illustrative and representative of prior attempts in this field. Each lacks the extreme simplicity of the present invention and none is completely satisfactory in function. Ideally, a ventilation stop should be able to be mounted quickly, easily and securely and thereafter should be able to be placed in operative and inoperative positions in a fool-proof manner. Additionally, it is desirable that the stop be able to secure the lower sash in the partially open position, that is, to hold it in this position. It is with respect to the foregoing aspects that the present invention has succeeded where prior attempts have only partially been successful, as will be now explained in greater detail.

SUMMARY OF THE INVENTION

In accordance with the present invention, a ventilation stop has been creatively designed which is adapted to be mounted to the side rail of the upper window sash of a double-hung window a predetermined distance above the upper horizontal rail of the lower sash. More particularly, the invention provides a stop comprising a flat, generally rectangular member having means for securing said member to the aforementioned side rail in such a manner that a portion thereof extends parallel to the upper horizontal rail. A wedge-shaped member is attached to the part extending from the side rail and projects therefrom with the small end of the wedge toward and into the path of the lower sash during relative movement between the upper sash and the lower sash. Preferably, the wedge, which may be mounted to a flat plate hinged along the upper edge of the rectangular member, can be swung up and over the mounting plate out of the path of the lower sash. One alternate configuration is of generally triangular cross section of sheet metal and has an upper edge extending for a considerable width hinged to the upper edge of the mounting plate. The particulars of construction of the above described device in accordance with the invention will be made clear in the following description and in the drawing in which:

DESCRIPTION OF PARTICULAR EMBODIMENTS

Figure 1:
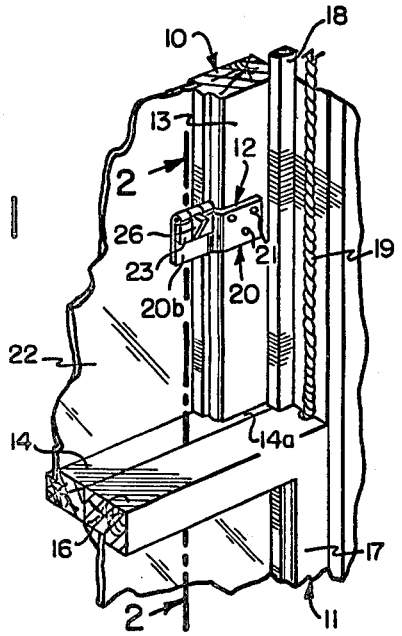
FIG. 1 is a perspective view (parts of which are broken away for clarity) of a ventilation stop according to the present invention installed on a typical double-hung wndow frame window.
Figure 4:
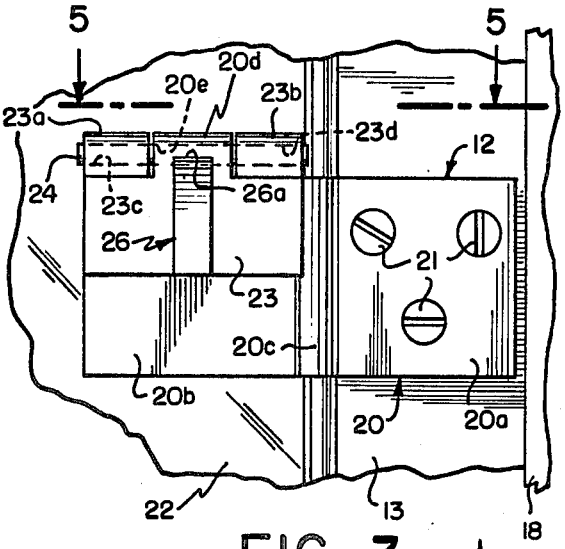
FIG. 4 is an enlarged front elevation view of the ventilation stop of the invention.
Figure 2:
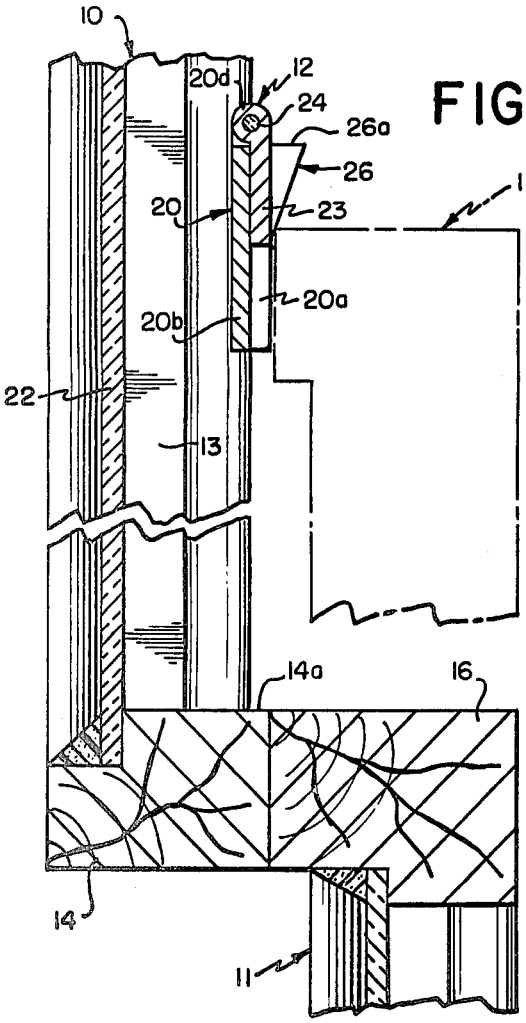
FIG. 2 is a section taken along line 2—2 of FIG. 1 showing the ventilation stop of the invention in its operative position.

Referring now to the drawing and initially to FIG. 1 thereof, a section of woodframe, double-hung window has been illustrated having an upper sash 10 and lower sash 11 and including the ventilation stop 12 of the present invention. The upper sash 10 includes a vertical side rail 13 and lower horizontal rail 14, and the lower sash 11 includes upper horizontal rail 16 and side rail 17. Vertical wood stop 18 separates and guides the respective upper and lower sash members in their relative movement with respect to each other. A cord 19 is affixed to the sash 11 and passes up and over a pulley (not shown) to a counterweight (also not shown).

The ventilation stop 12 in FIGS. 1–5 comprises a generally rectangular mounting plate 20 having a section **20*a* which is adapted to be affixed by means of screw attachments 21 to the side rail 13 of the upper sash, at a predetermined distance, say eight inches above the upper rail 16. It will be observed that the thickness of the section 20*a* is somewhat less than the width of section 14*a* so that when the lower sash 11 is moved upwardly relative to the upper sash 10 or when the upper sash 10 is moved downwardly relative to the lower sash 11, the sash members may freely pass each other provided the stop 12 of the invention is in its inoperative position. However, when the stop 12 is in its operative position, as will be more fully described, relative movements of each sash toward the other will be permitted only for the aforementioned predetermined distance that the stop 12 is mounted above the rail 16**.

Figure 3:
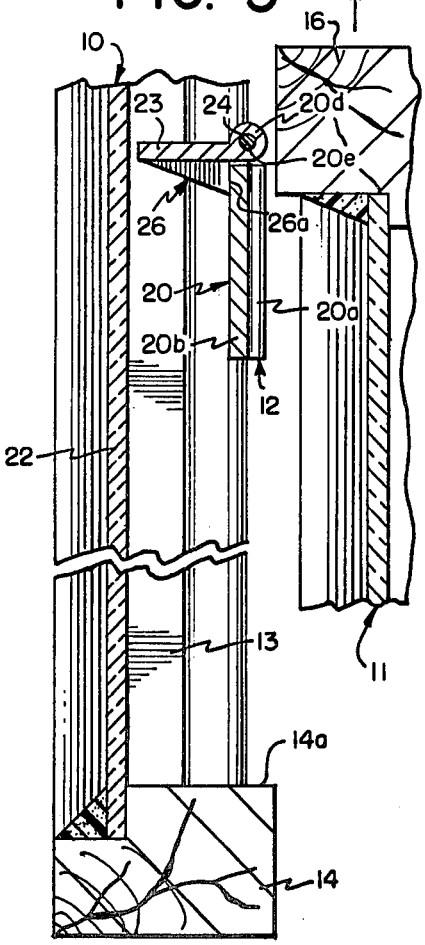
FIG. 3 is a section similar to that of FIG. 2 showing the ventilation stop in its inoperative position.
Figure 5:
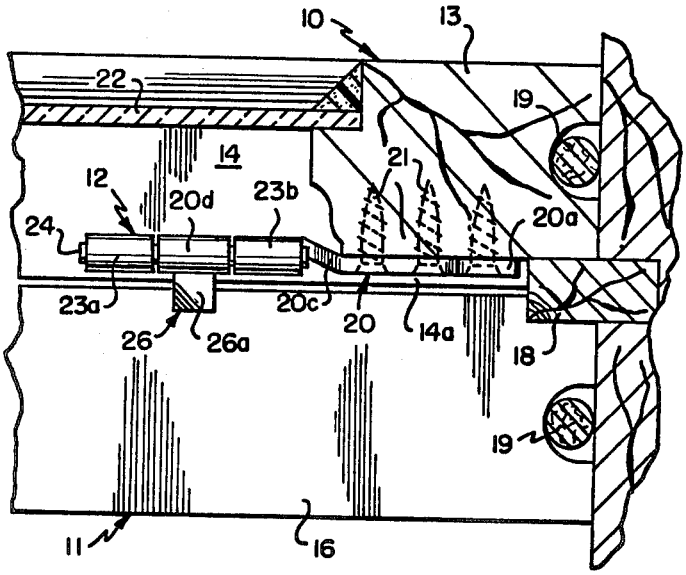
FIG. 5 is a view taken in the direction of arrows 5—5 of FIG. 4.

The mounting plate 20 further includes a section **20*b* which extends horizontally from the side rail 13 in a direction parallel to the upper rail 16 of the lower sash 11. Preferably, the section 20*b* is joggled toward the window pane 22, that is to say, is connected to section 20*a* by joggle 20*c* in a direction away from the path of movement between the lower sash 11 and upper sash 10. The upper edge of section 20*b* defines one-half of a hinge whose central section 20*d* includes horizontal cylindrical passage 20*e*. A supporting plate member 23 formed to have mating hinge halves 23*a* and 23*b* and matching aligned cylindrical passages 23*c*, 23*d*, receive, together with section 20*c*, a hinge pin 24. Integrally connected to the plate 23 is a narrow wedge-shaped member 26 whose small end is positioned toward the lower sash 11. Preferably, the angle of the wedge is such that when the upper rail 16 of the lower sash 11 is brought into contact with the wedge-shaped member, a jamming action results which effectively holds the upper and lower sash members in the stopped position. As shown in FIG. 3, the plate 23, together with wedge 26, can be moved into the inoperative position by flipping the plate 23 up and over the section 20***b* of the mounting plate 20. In this position, the surface 26*a* of the wedge 26 effectively stops movement of the plate 23 in its inoperative position as shown in FIG. 3.

Figure 6:
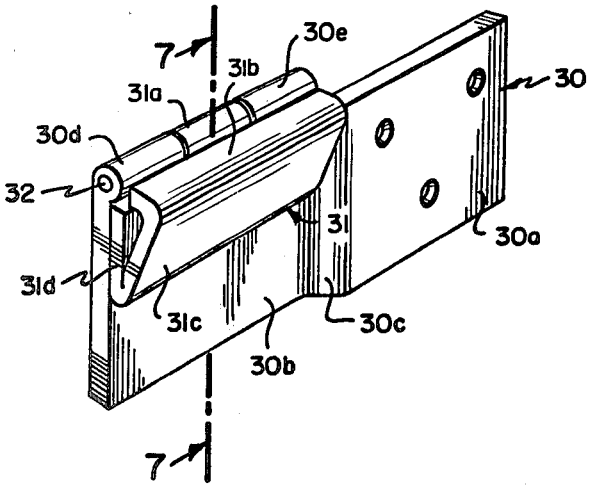
FIG. 6 is a front perspective view of an alternate form of the stop of the invention.
Figure 7:
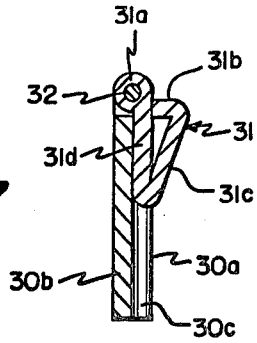
FIG. 7 is a section taken in the direction or arrows 7—7 of FIG. 6.

FIGS. 6 and 7 illustrate an alternate form of embodiment which the ventilation stop of the present invention may assume. In the embodiment of FIGS. 6 and 7, a rectangular mounting plate 30 having sections 30*a* and 30*b* and joggled area 30*c* similar to plate 20 and its sections has been illustrated. In the embodiment of FIGS. 6 and 7, the wedge-shaped member is not formed as a projection from a supporting plate but rather as a hinged plate 31 which is itself formed as a wedge. Plate 31 has a central hinge section 31*a* which mates with hinge sections 30*d* and 30*e* of mounting plate section 30*d* and is hinged for swinging movement relative thereof through the agency of hinge pin 32. Plage 31 is as shown formed as a wedge having upper horizontal section 31*b*, inclined section 31*c* and vertical section 31*d*. In the embodiment of FIGS. 6 and 7, it will be appreciated that the wedge-shaped member 31 can be formed to have a certain amount of inherent resilience such that when the upper rail of the lower sash member 1 is brought into contact against section 31*c*, some resilient flexing movement of section 31*c* toward section 31*d* can occur, thus assisting in the jamming action between the stop and the upper rail of the lower sash.

Figure 8:
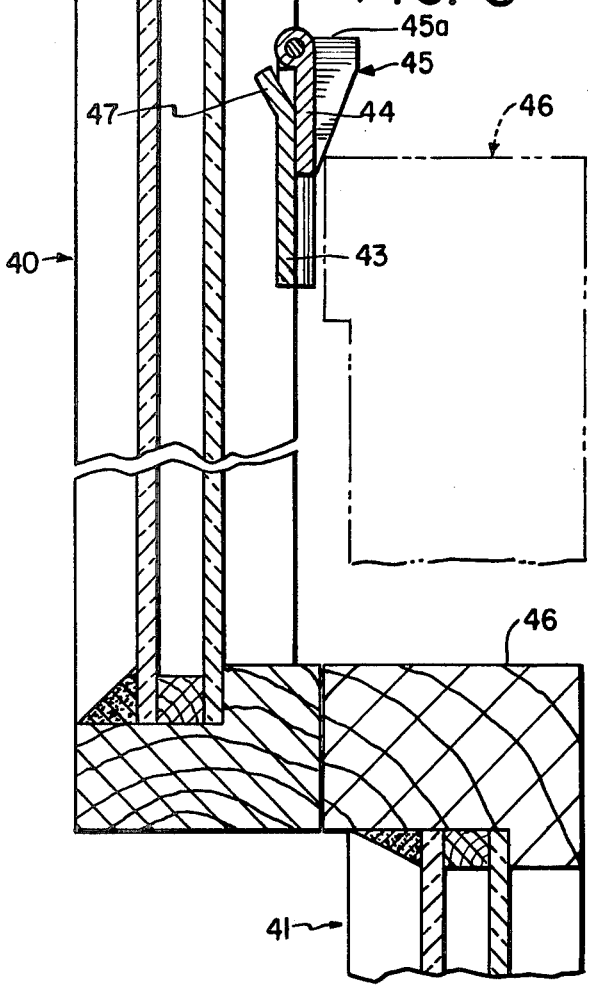
FIG. 8 is a partial cross sectional view of another embodiment of the ventilation stop according to the invention showing the stop in its operative position.
Figure 9:
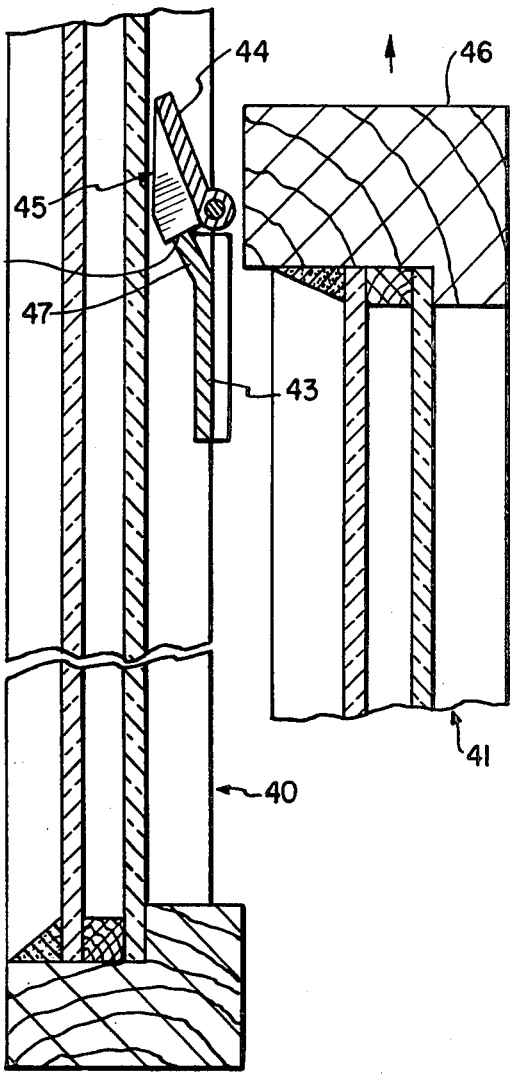
FIG. 9 is a view similar to FIG. 8 showing the stop in its inoperative position.
Figure 10:
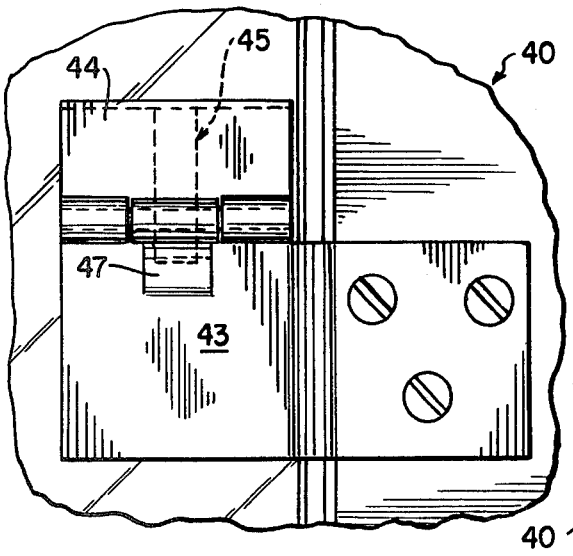
FIG. 10 is a side view of the stop of FIGS. 8 and 9.

FIGS. 8–10 disclose a variation of the ventilation stop of the present invention which may be used when space is limited in respect to the position of the wedge in its inoperative position. As illustrated in this embodiment, upper and lower window panes 40, 41 are of double or thermally insulated construction. As in the previous embodiments, the supporting plate member 43 is hinged along its upper edge to a plate 44 mounting wedge-shaped member 45. FIG. 8 shows the wedging action which will occur when wedge 45 is in its depending or operative position vis-a-vis the lower sash 46.

Plate 43 includes a projecting member 47 which, as best seen in FIG. 10, is bent at an angle from mounting plate 43 centrally of wedge mounting plate 44. As seen in FIG. 9, when the plate 44 and wedge 45 are flipped up and over the mounting plate 43, surface 45*a* of wedge 45 will abut against projecting member 47, thus limiting movement of the plate 44 and wedge 45. The degree to which these members should be angularly inclined toward the double pane 40 shall be sufficient to assure that in normal use vibration or other forces caused by movement of the upper or lower sash will not cause swinging movement of the plate 44 and wedge 45 from the inoperative position.

Figure 11:
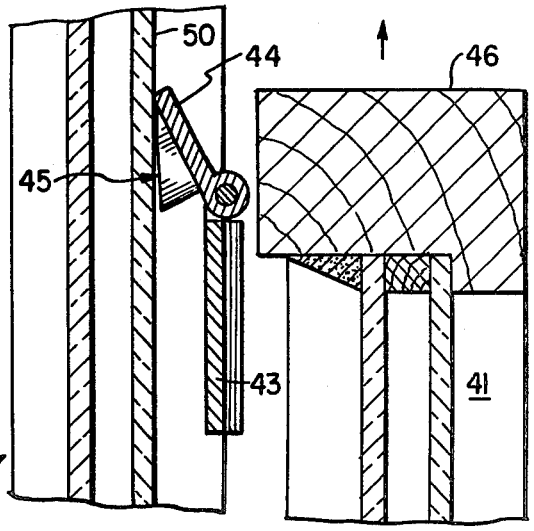
FIG. 11 is another embodiment of the ventilation stop according to the invention.

FIG. 11 is the same in all respects to the embodiment of FIGS. 8–10 except that the projecting member 47 has been eliminated. As seen in FIG. 11, when the wedge plate 44 and wedge 45 are swung up and over mounting plate 43 and into the inoperative position, the wedge 45 will rest inwardly against inner pane 50. Although the use of the projecting member 47 is desirable since the wedge is thus prevented from being thrown against the inner pane, nevertheless the embodiment of FIG. 11 has the virtue of greater simplicity, and because the distance traveled by the wedge in its swinging up and over movement is not great, careful use should avoid any harm to the pane 50.

In accordance with the above description of particular embodiments, it will be appreciated that the ventilation stop of the present invention is very simple and inexpensive, very easily mounted and yet extremely effective. Furthermore, because of the shape and positioning of the wedge member, the lower sash when raised up against it can effectively be held against gravity in the semi-open or ventilating position through the agency of the stop itself, quite apart from whether or not other means may be present in a particular window construction to hold the lower sash in the partially raised position. Furthermore, the stop of the present invention is easily rendered inoperative by merely flipping the plate to which the wedge is attached up and over the plate to which it is mounted.

It will be understood that the foregoing description has been of particular embodiments of the invention and has been therefore merely representative. In order to appreciate fully the scope of the invention, reference should be made to the appended claims.

I claim:

1. In combination with a double-hung window having a upper and a lower sash mounted for sliding vertical movement relative to each other, said upper and lower sashes having each respectively horizontal upper and lower and vertical side rails, a ventilation stop mounted to a side rail of the upper window sash a predetermined distance above the upper horizontal rail of the lower sash, said stop comprising a generally rectangular mounting plate, means for securing said mounting plate in a normally installed position to said side rail such that a section of said mounting plate extends from said side rail generally parallel to and above said upper horizontal rail, said section having an upper horizontal edge in said normally installed position, a wedge support plate hinged along one edge to the upper horizontal edge of said section about a horizontal axis to alternately depend therefrom inwardly and toward said lower sash in its operative position, a generally rigid wedge-shaped member attached to said wedge support plate, said wedge-shaped member defining a planar surface connected to said wedge support plate and projecting inwardly therefrom in its operative position such that a part of said planar surface lies toward and into the path of the upper horizontal rail of the lower sash during relative movement between the upper sash and the lower sash thereby effecting a stopping and jamming action of said horizontal rail against said planar surface, said wedge support plate being adapted to be swung about the upper horizontal edge of said section up and over said section to be inclined away from the path of said lower sash sufficiently to prevent said wedge support plate from moving into the operative position during normal movements of said sash, and means limiting the inclination of said wedge support plate in said inoperative position.

2. The ventilation stop according to claim 1 wherein said upper sash includes a pane of glass adjacent to said side rail and said means limiting movement of said wedge support plate is said pane of glass.

3. The ventilation stop according to claim 1 wherein a member is mounted upon said section to project therefrom toward said wedge to limit movement of said wedge away from said path in the inoperative position.

* * * * *